United States Patent [19]

Baker et al.

[11] 4,392,706

[45] Jul. 12, 1983

[54] ELECTRICAL CONNECTOR WITH LATCHING MEANS

[75] Inventors: Robert W. Baker, Kenton; Leonard J. Owen, Watford; Reginald J. Simmons, South Harrow, all of England

[73] Assignee: AMP Incorporated, Harrisburg, Pa.

[21] Appl. No.: 256,650

[22] Filed: Apr. 23, 1981

[30] Foreign Application Priority Data

May 2, 1980 [GB] United Kingdom ..... 8014610
Oct. 7, 1980 [GB] United Kingdom ..... 8032282

[51] Int. Cl.[3] ..... H01R 13/629
[52] U.S. Cl. ..... 339/91 R
[58] Field of Search ..... 339/91 R

[56] References Cited

U.S. PATENT DOCUMENTS

| | | | |
|---|---|---|---|
| 3,933,406 | 1/1976 | Cameron et al. | 339/91 R |
| 4,010,998 | 3/1977 | Tolnar, Jr. et al. | 339/91 R |
| 4,026,624 | 5/1977 | Boag | 339/91 R |
| 4,192,568 | 3/1980 | Marks et al. | 339/91 R |
| 4,273,403 | 6/1981 | Cairns | 339/91 R |

FOREIGN PATENT DOCUMENTS 216880 1/1976 Spain .

*Primary Examiner*—John McQuade
*Attorney, Agent, or Firm*—F. Brice Faller

[57] ABSTRACT

A two part connector has latch arms (4) and ramps (3) which latch together to give positive mating in known manner. To facilitate release the arms (4) are depressible in the mated condition to allow withdrawal of latch projections (6) below ramps (3). Resilient stop fingers (15) may be provided to inhibit mismating.

7 Claims, 17 Drawing Figures

FIG.7.
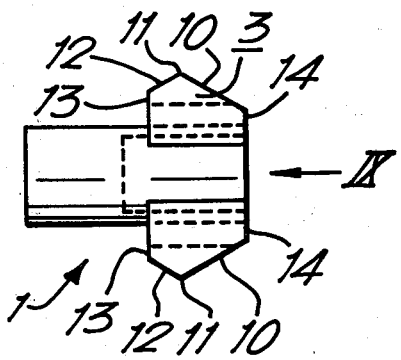
FIG.9.
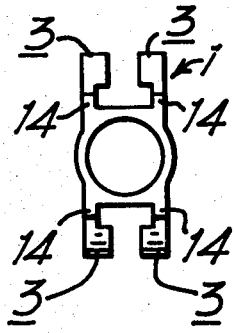
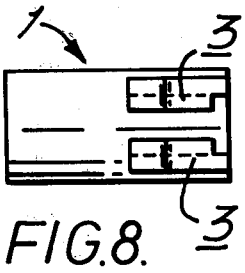
FIG.8.
FIG.10.
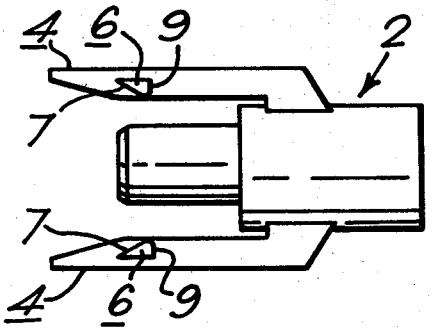
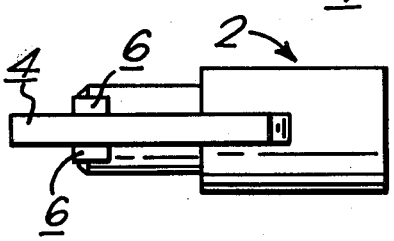
FIG.11.

FIG.12.
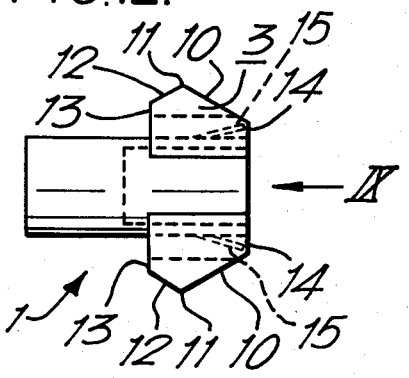
FIG.13.
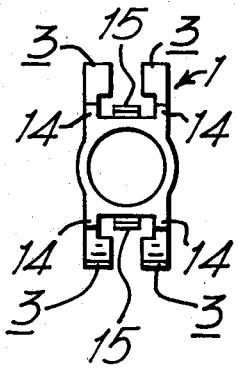
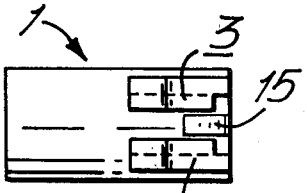
FIG.14.
FIG.15.
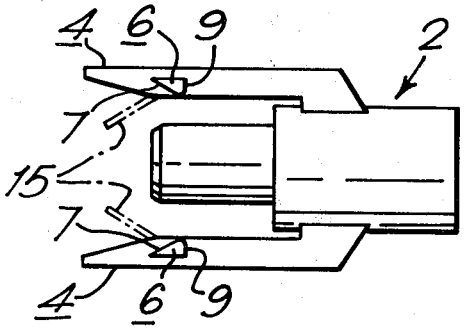
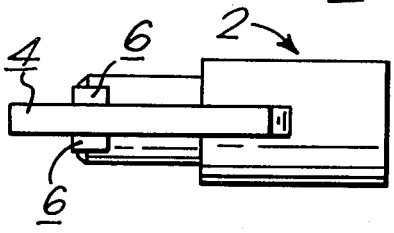
FIG.16.

ELECTRICAL CONNECTOR WITH LATCHING MEANS

This invention relates to an electrical connector assembly, and particularly to an electrical connector assembly comprising two housing parts each containing one or more terminals, the housing parts and terminals being such that the housing parts can be mated thereby to mate the terminals contained therein, the housing parts having interengaging latching members which serve to secure the housing parts together in their mated condition.

With some known such connectors it is often possible for the two housing parts to remain only partially mated without the terminals therein being fully mated, and thus with the connector providing inadequate or even no electrical connections.

This is because with such known connectors the two housing parts to be mated must be urged together with sufficient force to overcome not only the maximum resistance offered by the latching members as they engage, but also the resistance offered by the engaging terminals in the two housing parts.

The force required to engage and disengage the terminals of such a connector can be relatively high, particularly when a large number of terminals are being mated simultaneously, since the terminals will require a relatively high contact force to ensure satisfactory electrical connection.

Thus, with such known connectors the two housing parts can remain in a condition in which the terminals are only partially mated and the latching members are not fully engaged, any resistance force still being offered by the latching members being overcome by the total contact force of the terminals.

Such known connectors can therefore be left in a condition in which the two housing parts are not effectively secured together by the latching members, and thus such that the two housing parts may subsequently become disengaged due, for example, to vibration or the application of relatively low pull-apart forces.

In order to overcome these disadvantages, in another known such electrical connector assembly the resistance offered by the latching members on mating of the two housing parts must be overcome before the mating terminals in the two housing parts offer any appreciable resistance to mating of the two housing parts, and when the mating terminals offer resistance to mating of the two housing parts, the latching members provide a force which assists in mating of the two housing parts.

Thus, with this particular known assembly partial mating of the terminals in the two housing parts is extremely unlikely since if the mating force is removed before the resistance to mating offered by the latching members has been overcome, then the two housing parts will be urged apart again by the resistance force of the latching members, the terminals being unable to prevent this action since they will then be providing virtually no contact force, and when the two housing parts are fully mated the latching members continue to provide a force tending to urge the two housing parts together, thus helping to maintain the two housing parts in their correct fully mated condition.

A disadvantage of this particular known connector assembly is that while mating of the two housing parts, and retention of the two housing parts in the mated condition, are ensured, unmating of the two housing parts can be difficult since not only the contact forces of the mated terminals but also the force provided by the latching members must be overcome.

According to this invention there is provided an electrical connector assembly comprising two housing parts each containing one or more terminals, the housing parts and terminals being such that the housing parts can be mated thereby to mate the terminals contained therein. The housing parts having interengaging latching members which serve to secure the housing parts together in their mated condition, the resistance offered by the latching members on mating of the two housing parts having to be overcome before the mating terminals in the two housing parts offer any appreciable resistance to mating of the two housing parts. The latching members then provide a force which assists in mating of the two housing parts when the mating terminals offer resistance to mating of the two housing parts. The latching members comprise on one housing part a ramp or ramps on each of two opposite sides of the housing part, and on the other housing part a resilient cantilever arm on each of two opposite sides of the housing part, each arm carrying a pair of projections adapted and arranged to ride over a ramp on the one housing part as the two housing parts are mated. The ramps on the one housing part and the projections on the arms of the other housing part have co-operating surfaces extending normally of the mating direction of the housing parts, which surfaces engage when the housing parts are fully mated, to prevent unmating of the housing parts. The ramps are supported spaced from the one housing part by limbs extending from the one housing part which permit disengagement of the co-operating surfaces of the ramps and projections when the housing parts are mated. This enables the housing parts to be unmated with the projections on the arms of the other housing part passing under the ramps on the one housing part.

The assembly of this invention has the advantages that the two housing parts are positively secured in the mated condition with unmating being impossible until the latching members are appropriately manipulated, at which the two housing parts can be relatively easily unmated since only the contact forces of the terminals have to be overcome.

Electrical connector assemblies according to this invention will now be described by way of example with reference to the drawings, in which:

FIG. 7 is a side elevational view of the first housing part of the second assembly;

FIG. 8 is a plan view of the first housing part of the second assembly;

FIG. 9 is a view in the direction of the arrow IX in FIG. 7;

FIG. 10 is a side elevational view of the second housing part of the second assembly;

FIG. 11 is a plan view of the second housing part of the second assembly;

FIG. 12 is a side elevational view of the first housing part of a further assembly;

FIG. 13 is a view in the direction of the arrow IX in FIG. 12;

FIG. 14 is a plan view of the first housing part of the further assembly;

FIG. 15 is a side elevational view of the second housing part of the further assembly; and FIG. 16 is a plan view of the second housing part of the further assembly.

Figure 1:
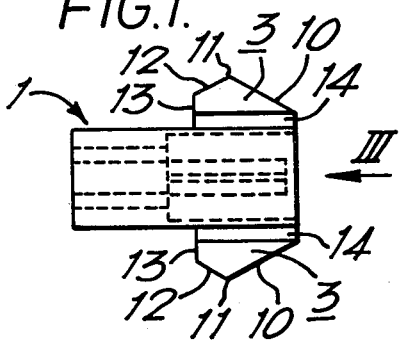
FIG. 1 is a side elevational view of the first housing part of a first assembly.

The assembly shown in FIGS. 1 to 6 comprises a first housing part 1 (FIGS. 1 to 3) which is moulded from plastics material, and which for use contains a plurality of electrical terminals (not shown), and a second housing part 2 (FIGS. 4 to 6) which is also moulded from plastics material, and which for use contains a plurality of terminals (not shown) to mate with the terminals in the first housing part 1.

The form of the terminals, and the manner in which they are retained in the housing parts 1 and 2, are not critical to this invention and will not therefore be described in detail herein. All that must be understood is that when the two housing parts 1 and 2 are fully mated, the terminals will be effectively mated. Further, it will be appreciated that for use the terminals will be connected to individual electrical conductors which are not shown in the drawings.

The housing parts 1 and 2 are provided with cooperating latching members in the form of a pair of ramps 3 one on each of two opposite sides of the housing part 1, and a pair of outwardly cranked resilient cantilever arms 4 extending one from each of two opposite sides of the housing part 2. Each arm 4 is split longitudinally (see FIG. 5) over most of its length into two members 4*a*, but has a plate 5 which bridges the two arm members at the end of the arm 4 remote from the housing part 2.

Figure 6:
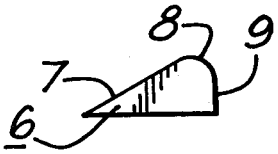
FIG. 6 shows a detail of the second housing part of the first assembly.

On the inner surface of each member 4*a* of each arm 4 is a projection 6 as shown in FIG. 6, each projection 6 having a first surface 7 which slopes inwardly towards the housing part 2 and which merges at a rounded corner 8 with a surface 9 extending normally of the mating direction of the two housing parts 1 and 2, that is normally of the longitudinal axis of the second housing part 2.

As the housing parts 1 and 2 are urged axially towards each other to mate them, the surfaces 7 of the four projections 6 each ride up the outwardly sloping surface 10 of the associated ramp 3 on the first housing part 1, this engagement resiliently bending the associated arm 4. This engagement between the surfaces 7 of the projections 6 and the surfaces 10 of the ramps 3 provides a resistance force which must be overcome for the housing parts 1 and 2 to be mated.

When the projections 6 are nearly at the peaks 11 of the ramps 3 the terminals in the housing parts 1 and 2 have not presented any appreciable resistance to mating of the housing parts 1 and 3. Thus, if the mating force urging the housing parts 1 and 2 together is removed, then the resistance forces of the arms 4 acting on the ramps 3 will urge the housing parts 1 and 2 away from each other, and the housing parts 1 and 2 will not remain in a partially mated condition.

Further movement of the housing parts 1 and 2 towards each causes the rounded corners 8 of the projections 6 to pass over the peaks 11 of the ramps 3 and the terminals in the housing parts 1 and 2 become fully mated, this mating being assisted by the resilience forces of the arms 4 acting on the inwardly sloping surfaces 12 of the ramps 3, which face away from the second housing part 2.

When the housing parts 1 and 2 are fully mated the surfaces 9 of the projections 6 engage surfaces 13 of the ramps 3, which extend, like the surfaces 9, normally of the mating direction of the housing parts 1 and 2, and the housing parts 1 and 2 are thus positively locked against unmating.

Figure 3:
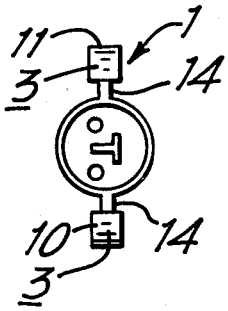
FIG. 3 is a view in the direction of the arrow III in FIG. 1.
Figure 2:
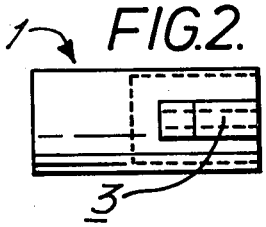
FIG. 2 is a plan view of the first housing part of the first assembly.

As best seen in FIG. 3, the ramps 3 are supported spaced from the supporting wall of the housing part 1 by limbs 14 which are of less width than the associated ramps 3 and which support the associated ramps 3 at a distance slightly greater than the height of the associated projections 6 of the second housing part 2. Thus, when the housing parts 1 and 2 are mated with the surfaces 9 of the projections 6 engaging the surfaces 13 of the ramps 3, pressure on the plates 5 on the arms 4 towards the housing part 2 will deflect the arms 4 towards the housing part 2, thus disengaging the surfaces 9 and 13 and enabling the housing parts 1 and 2 to be easily unmated with the projections 6 passing under the ramps 3, and the two projections 6 on each arm 4 passing along opposite sides of the limb 14 supporting the associated ramp 3.

Thus, although the housing parts 1 and 2 are positively secured together in the mated condition by the engagement between the surfaces 9 on the projections 6 and the surfaces 13 on the ramps 3, the housing parts can still be easily unmated by appropriate action on the arms 4 with only the contact forces between the terminals in the housing parts 1 and 2 to be overcome.

Referring now to FIGS. 7 to 11, the assembly here shown is similar to that of FIGS. 1 to 6, and corresponding parts have been given the same reference numerals.

The essential differences are that in this second assembly each arm 4 of the second housing part 2 is only a single member and carries a projection 6 on each of its outwardly facing side surfaces, while there are two ramps 3 on each side of the first housing part 1, the two ramps 3 being separated laterally of the first housing part 1 by a distance just greater than the width of the associated arm 4 of the second housing part 2.

On mating of the housing parts 1 and 2, each arm 4 passes between the associated ramps 3 and the projections 6 on the arm 4 ride over the associated ramps 3 until the housing parts 1 and 2 are secured in the mated condition by engagement of the surfaces 9 of the projections 6 with the surfaces 13 of the ramps 3.

To unmate the housing parts 1 and 2 the arms 4 are depressed towards the housing part 2 to disengage the surfaces 9 and 13, whereby the housing parts 1 and 2 can be moved away from each other with the projections 6 on each arm 4 passing under the associated ramps 3 and between the limbs 14 supporting the ramps 3.

In assemblies of the kind described so far, a potential disadvantage is that if, when the housings are mated, the arms 4 are depressed towards the respective housing parts, the projections 6 will not ride over the ramps 10, 12 to give the positive mating, but may pass under the ramps and be left in only a partially mated condition.

Figure 4:
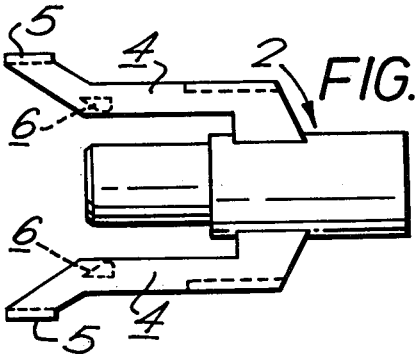
FIG. 4 is a side elevational view of the second housing part of the first assembly.
Figure 4A:
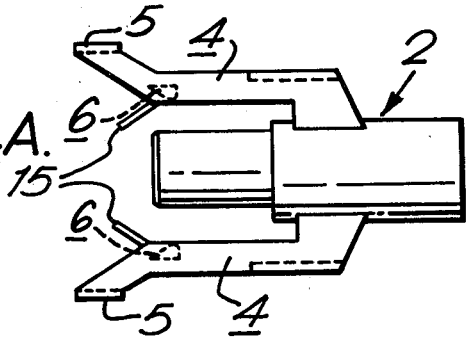
FIG. 4A is a view similar to that of FIG. 4 but of a modified embodiment.
Figure 5:
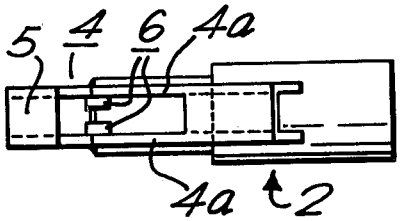
FIG. 5 is a plan view of the second housing part of the first assembly.

In the modified embodiment of FIG. 4A, the housing part 2 is formed with stop members in the form of resilient fingers 15 on the arms 4, the fingers 15 being positioned nearer the free ends of the arms 4 than the projections 6, and having their free ends directed obliquely inwardly and in the mating direction.

When the modified housing part 2 of FIG. 4A is mated with a housing part 1 of FIG. 1, the free ends of the fingers 15 rest against the housing part 1. When the arms 4 are deflected inwardly towards the housing parts 1 and 2 to permit unmating, the fingers 15 are flattened towards the arms 4 and permit the projections 6 to pass under the ramps as described in connection with FIGS. 1 to 6. However, if an attempt is made to mate the housing parts 1 and 2 with the arms 4 depressed, then the housing part 1 will engage the fingers 15 to inhibit engagement of the housing parts and prevent them being engaged in a partially mated condition.

Referring now to FIGS. 12 to 16, the assembly here shown is similar to that of FIGS. 7 to 11, and corresponding parts have been given the same reference numerals.

As shown in dotted lines in FIG. 15, stop members in the form of fingers 15 as shown in the embodiment of FIG. 4A can also be provided in this assembly. Further, instead of providing the fingers 15 on the housing part 2 of this assembly, they can, as shown in FIGS. 12, 13 and 14, be provided on the housing part 1 beneath and between the ramps 3 thereon and having their free ends directed obliquely outwardly towards the mating end of the housing part 1, such fingers 15 functioning generally in the same manner as those otherwise provided on the housing part 2.

What is claimed is:

1. An electrical connector assembly comprising two housing parts each containing one or more terminals, the housing parts and terminals being such that the housing parts can be mated thereby to mate the terminals contained therein, the housing parts having interengaging latching members which provide a force which assists in mating of the two housing parts, and which serve to secure the housing parts together in their mated condition, the latching members comprising on one housing part a ramp or ramps on each of two opposite sides of the housing part, and on the other housing part a resilient cantilever arm on each of two opposite sides of said other housing part, each arm carrying a projection adapted and arranged to ride over a ramp on the one housing part as the two housing parts are mated, the ramps on the one housing part and the projections on the arms of the other housing part having cooperating surfaces which engage when the housing parts are fully mated, to prevent unmating of the housing parts, in which the ramps are supported on the one housing part such that deflection of the arms of the other housing part towards the one housing part when the housing parts are mated disengages the cooperating surfaces of the ramps and projections and enables the housing parts to be unmated without further deformation of the arms, with the projections on the arms of the other housing part passing under the ramps on the one housing part, whereby the projections offer no resistance to unmating of the housing parts.

2. An assembly as claimed in claim 1, in which said one housing part has a single said ramp on each of said opposite sides, each said ramp being supported by a limb of less width than said ramp, and each arm on the other housing part is split longitudinally into two members, there being a projection on the inner surface of each member, which projections pass along opposite sides of the respective limb when the housing parts are unmated.

3. An assembly as claimed in claim 1, in which each arm of the other housing part carries a projection on each of its outwardly facing side surfaces, there being two ramps on each side of the one housing part respectively associated with the two projections on the associated arm, the two ramps being separated laterally of the one housing part, the projections on each arm passing under the associated ramps and between the limbs supporting the two ramps associated with the arm when the housing parts are unmated.

4. An assembly as claimed in claim 1, in which resilient stop members are provided on the one housing parts arranged and adapted to inhibit mating of the housing parts when the arms of the other housing part are deflected towards the one housing part but which by flexure permit unmating with the arms in that position.

5. An assembly as claimed in claim 2, in which each arm is provided with a stop member in the form of a resilient finger directed obliquely inwards and in the mating direction, the stop members being arranged to inhibit mating of the housing parts when the arms of the other housing part are deflected towards the one housing part but which by flexure permit unmating with the arms in that position.

6. An assembly as claimed in claim 5, in which the fingers are positioned forwardly of the projections in the mating direction.

7. An assembly as claimed in claim 3, in which the one housing part is provided with stop members in the form of resilient fingers positioned beneath the ramps and directed obliquely outwardly and in the mating direction, the fingers being arranged to inhibit mating of the housing parts when the arms of the other housing part are deflected towards the one housing part but which by flexure permit unmating with the arms in that position.

* * * * *